US008774448B2

(12) United States Patent
Li et al.

(10) Patent No.: US 8,774,448 B2
(45) Date of Patent: Jul. 8, 2014

(54) SPEAKER WITH ELASTIC PLATE COUPLED TO DIAPHRAGM

(71) Applicants: Lin-Zhen Li, Shenzhen (CN); Xiong Zhang, Shenzhen (CN)

(72) Inventors: Lin-Zhen Li, Shenzhen (CN); Xiong Zhang, Shenzhen (CN)

(73) Assignees: AAC Acoustic Technologies (Shenzhen) Co., Ltd., Shenzhen (CN); AAC Acoustic Technologies (Changzhou) Co., Ltd., Chanzhou (CN)

( * ) Notice: Subject to any disclaimer, the term of this patent is extended or adjusted under 35 U.S.C. 154(b) by 0 days.

(21) Appl. No.: 14/010,699

(22) Filed: Aug. 27, 2013

(65) Prior Publication Data

US 2014/0056465 A1 Feb. 27, 2014

(30) Foreign Application Priority Data

Aug. 27, 2012 (CN) ..... 2012 2 0427580 U

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 9/02*** | (2006.01) |

(52) U.S. Cl.

CPC ..... *H04R 9/025* (2013.01)

USPC ..... 381/400; 381/398

(58) Field of Classification Search

CPC ..... H04R 5/02; H04R 9/02; H04R 9/022; H04R 9/025; H04R 31/00; H04R 31/003; H04R 31/006; H04R 2207/021

USPC ..... 381/152, 162, 191, 396–398, 400, 403, 381/405, 412, 420–423, 419, 431; 181/148, 181/157, 161, 164–166, 171–172

See application file for complete search history.

(56) References Cited

U.S. PATENT DOCUMENTS

| | | | | |
|---|---|---|---|---|
| 6,832,106 | B2 * | 12/2004 | Sugata et al. | 455/567 |
| 2006/0182305 | A1 * | 8/2006 | Steere et al. | 381/423 |
| 2011/0274309 | A1 * | 11/2011 | Doh et al. | 381/398 |
| 2012/0269378 | A1 * | 10/2012 | Stead | 381/396 |

* cited by examiner

*Primary Examiner* — Brian Ensey
*Assistant Examiner* — Katherine Faley
(74) *Attorney, Agent, or Firm* — IPro, Inc.; Na Xu

(57) ABSTRACT

A speaker includes a vibrating unit, and a magnetic circuit unit. The vibrating unit includes a diaphragm, an elastic plate coupled with the diaphragm, and a voice coil electrically connecting to the elastic plate. The vibrating unit is mounted to and positioned by the magnetic circuit unit. A projection of the diaphragm on the magnetic circuit unit is disposed within an outline of the magnetic circuit unit. The speaker has no frame or any structure with a frame configuration, which makes the magnetic circuit unit larger and more powerful.

12 Claims, 5 Drawing Sheets

SPEAKER WITH ELASTIC PLATE COUPLED TO DIAPHRAGM

FIELD OF THE INVENTION

The present invention relates to the art of speakers, particularly to a micro-speaker used in an electronic device.

DESCRIPTION OF RELATED ART

Micro-speakers have been widely used in portable electronic devices, such as cellular phones, notebooks, and so on. With the continuing development of the portable electronic devices, people request for more and more functions with audible sensations, which brings a rapid development of the technologies of micro-speakers.

A related micro-speaker includes a frame, a vibrating unit and a magnetic circuit unit attached to the frame. The vibrating unit includes a diaphragm attached to the frame, and a voice coil for driving the diaphragm to vibrate. The magnetic circuit unit includes a yoke positioned to the frame and a magnet disposed in the yoke. Generally, the micro-speaker of the related art includes terminals serving as electrodes for providing electronic signals to the voice coil. The terminals are also positioned by the frame.

The frame is used to accommodate the magnetic circuit unit, and to support the diaphragm and the terminals. However, the frame of the related micro-speaker takes a lot of space, which makes the magnetic circuit unit have a small size and the micro-speaker have a low sensitivity.

Therefore, it is desirable to provide a speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENT

Figure 1:
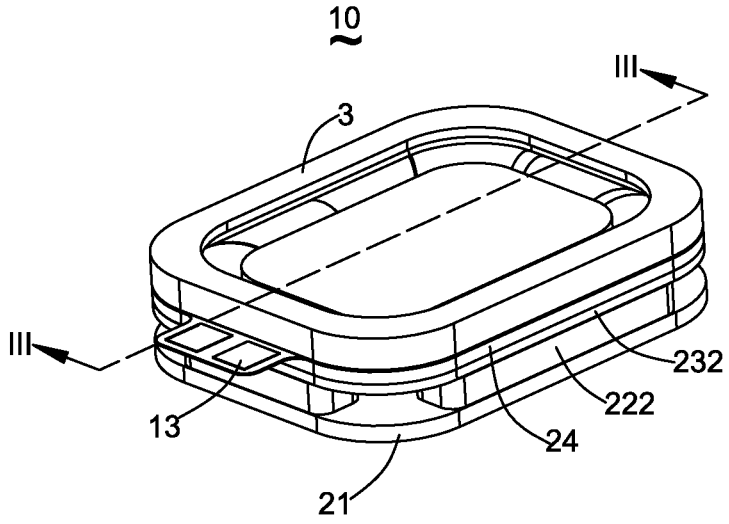
FIG. 1 is an isometric view of a speaker in accordance with a first embodiment of the present invention.
Figure 2:
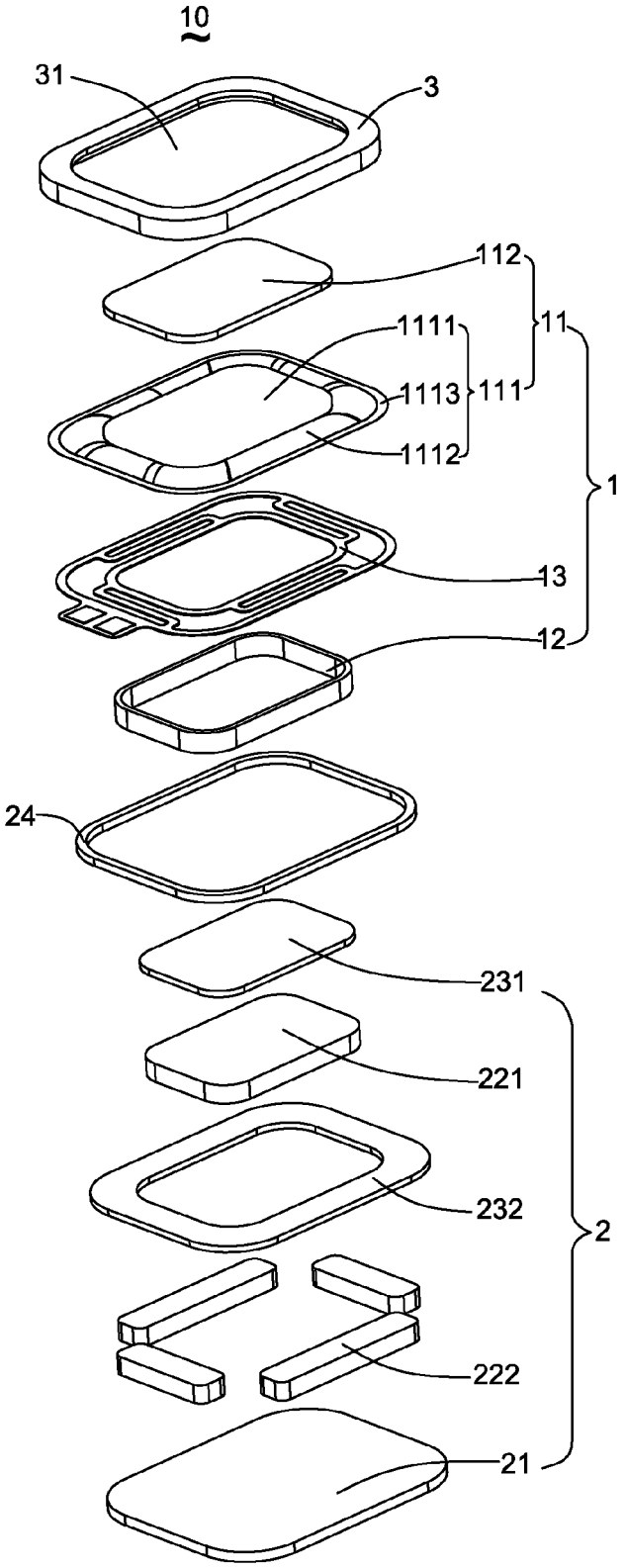
FIG. 2 is an exploded view of the speaker of FIG. 1.

Referring to FIGS. 1-3*b*, a speaker 10 in accordance with a first embodiment of the present invention, includes a vibration unit 1 and a magnetic circuit unit 2. The vibration unit 1 includes a diaphragm 11, a voice coil 12 capable of driving the diaphragm 11 to vibrate, and an elastic plate 13 for providing electrical signals to the voice coil 12. The diaphragm 11 includes a base film 111 and a top plate 112 attached on the base film 111. The base film 111 includes a flat central portion 1111, a curved portion 1112 extending from the central portion 1111 and surrounding around the top plate 112, and a position portion 1113 disposed at an edge of the base film 111. In other embodiment, the flat central portion 1111, or the top plate 112 of the diaphragm 11 could be omitted. The elastic plate 13 is used to electrically connect two lead wires of the voice coil 12 for transmitting electrical signals from an external circuit to the voice coil 12. Since the elastic plate 13 serves as a conductive intermedium between the external circuit and voice coil, the position of the elastic plate 13 is variable according to actual requirements. In this embodiment, the elastic plate 13 is a flexible printed circuit board, and is located below the diaphragm 11. The voice coil 12 is attached to the elastic plate 13. In other words, the elastic plate 13 is sandwiched between the diaphragm 11 and the voice coil 12. Alternatively, the elastic plate 13 may be located above the diaphragm 11, and the lead wires of the voice coil 12 may be connected to the elastic plate 13 passing through the diaphragm. And alternatively, the elastic plate 13 may still be located below the diaphragm 11, but the voice coil 12 attaches to the diaphragm 11, not to the elastic plate 13.

The magnetic circuit unit 2 includes a base board 21, a first magnetic conduction member 221 disposed at a center portion of the base board 21, a second magnetic conduction member 222 disposed at a periphery portion of the base board 21 for forming a magnetic gap with the first conduction member 221. At least one of the first and second magnetic conduction members 221,222 is a permanent magnet. In this embodiment, four separated second magnetic conduction members 222 are provided to surround the first magnetic conduction member 221. Each two adjacent second magnetic conduction member 222 forms a gap therebetween. In other embodiment, the amount of the second magnetic conduction members 222 is variable corresponding to actual requirements, and the second magnetic conduction member 222 may be an integrated ring-shaped configuration without gaps. The voice coil 12 has one end accommodated in the magnetic gap and the other end connected with the diaphragm 11 or with the elastic plate 13. The term "connect" means to connect something to another via a medium or to connect something to another directly without any medium.

The magnetic circuit unit is a necessary component or combination of a plurality of components used in an electro-acoustic device. The magnetic circuit unit is used to provide a closed loop of a magnetic field, and is formed by magnetic conduction materials. In this embodiment, the magnetic circuit unit 2 further includes a first pole plate 231 attached on a top face of the first magnetic conduction member 221 and a ring-shaped second pole plate 232 attached on top faces of the second magnetic conduction member 222. The shape of the second pole plate 232 is not restricted to the ring as described in this embodiment. Alternatively, the second pole plate 232 may be a rectangular plate corresponding to each of the second magnetic conduction members 222. While electrified, the voice coil 12 drives the diaphragm 11 to vibrate along a vibration direction by the interaction between the voice coil 12 and the magnetic circuit unit 2. Generally, the vibration direction is perpendicular to the base board 21.

Figure 3A:
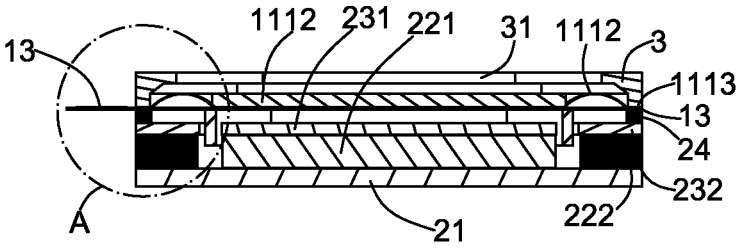
FIG. 3*a* is a cross-sectional view of the speaker taken along line III-III of FIG. 1.
Figure 3B:
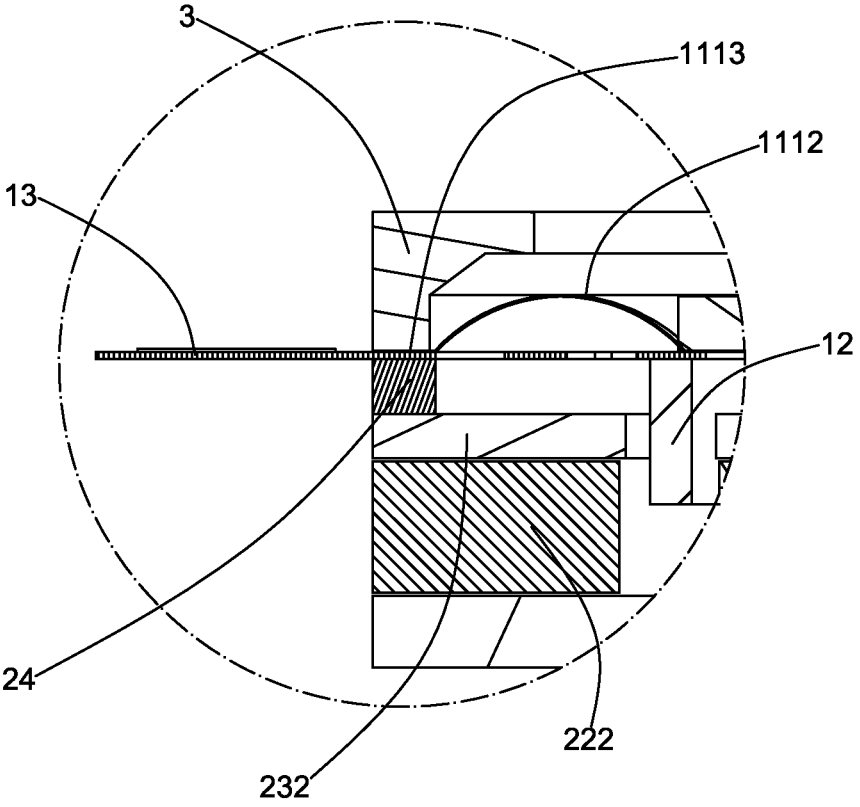
FIG. 3*b* is an enlarged view of circled Part A of FIG. 3*a*.

Referring to FIGS. 1-3*b*, particularly to FIGS. 3*a*-3*b*, a gasket 24 is attached on the second pole plate 232. The vibrating unit 1 is connected to the magnetic circuit unit 2 with the position portion 1113 of the diaphragm 11 positioned on a top face of the gasket 24. In this embodiment, the elastic plate 13 is located below the diaphragm 11, so the elastic plate 13 is sandwiched between the position portion 1113 and the gasket 24. Alternatively, the elastic plate 13 may be located above the diaphragm 11, so the diaphragm 11 may be sandwiched between the elastic plate 13 and the gasket 24. The gasket 24 has a top face higher than the first pole plate 232 so that a greater vibration space is formed for the diaphragm 11. In fact, the gasket 24 is an optional element for increasing the vibration space of the diaphragm 11. It is also feasible that the combination of the diaphragm 11 and the elastic plate 13 is directly connected to the magnetic circuit unit 2 without the gasket 24, like the second embodiment which will be described in later paragraph. Again, the term "connect" here means to connect something to another via a medium or to connect something to another directly without any medium.

The curved portion 1112 of the diaphragm 11 is disposed above the second pole plate 232. In this embodiment, the curved portion 1112 is convex. When the elastic plate 13 is located above the diaphragm 11, the curved portion 1112 could be concave. A projection of the diaphragm 11 on the base board 21 along the vibration direction of the diaphragm 11 is within an outline of the base board 21. Compared with the related art, the diaphragm is supported by the magnetic circuit unit, and the voice coil is accommodated in the space formed by the diaphragm and the magnetic unit, which configuration omits the frame used in related art. In addition, if provided with a same size to the related art, the magnetic circuit unit could be enlarged for providing improved performance.

Optionally, the speaker 10 further includes a front cover 3 attached to the vibrating unit 1 and the magnetic circuit unit 2. The front cover 3 has an acoustic hole 31 for emitting sounds generated by the diaphragm 11. In addition, the front cover 3 presses on the position portion 1113 of the diaphragm 11 for fixing the diaphragm 11 on the magnetic circuit unit 2. While assembled, the elastic plate 13 has a distal end protruding from an outer side formed by the position portion 1113, the gasket 24 and the magnetic circuit unit 2 for being capable of connecting to the external circuit.

Figure 4:
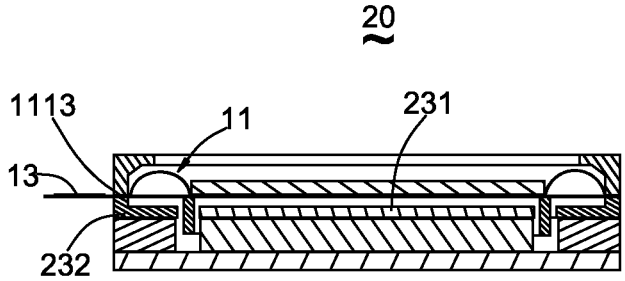
FIG. 4 is a cross-sectional view of a speaker in accordance with a second embodiment of the present invention.

Referring to FIG. 4, a speaker 20 in accordance with a second embodiment of the present invention, has no gasket as described in the first embodiment. The combination of the position portion 1113 of the diaphragm 11 and the elastic plate 13 is positioned directly on the second pole plate 232. Optionally, the second pole plate 232 has a top face higher than that of the first pole plate 231 thereby providing a greater vibration space to the diaphragm 11. In fact, this embodiment provides a solution that the combination of the diaphragm 11 and the elastic plate 13 directly connects to the magnetic circuit unit.

Figure 5:
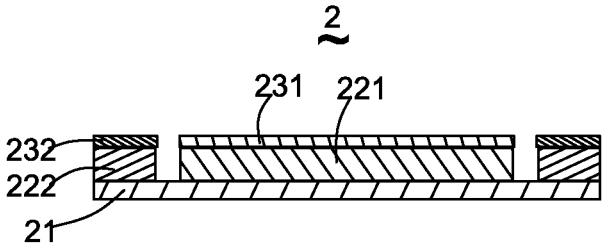
FIG. 5 is a cross-sectional view of a magnetic circuit unit of a speaker in accordance with the first embodiment of the present invention.

FIG. 5 illustrates the magnetic circuit unit 2 of the speaker 10 in accordance with the first embodiment of the present invention, in which both the first magnetic conduction member 221 and the second magnetic conduction member 222 are permanent magnets. The second magnetic conduction member 222 may be a ring surrounding the first magnetic conduction member 221, or may be a plurality of separated pieces arranged around the first magnetic conduction member 221. The magnetic circuit unit 2 is used to provide a magnetic gap and to support the diaphragm, no matter how the first or second magnetic conduction member 221, 222 is configured.

Figure 6:
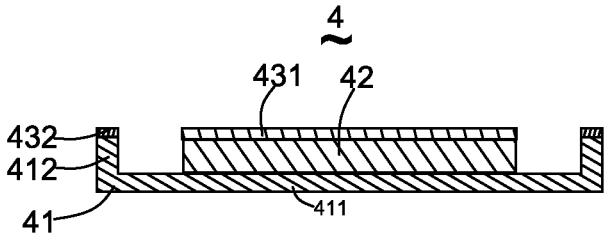
FIG. 6 is a cross-sectional view a magnetic circuit unit of a speaker in accordance with a third embodiment of the present invention.

Referring to FIG. 6, a magnetic circuit unit 4 of a speaker in accordance with a third embodiment of the present invention, includes a bowl-shaped yoke 41 with a bottom wall 411 and a sidewall 412 extending upwards from an edge of the bottom wall 411, a magnet 42 disposed within the yoke 41, an inner pole plate 431 attached on the magnet 42, and an outer pole plate 432 attached on a top face of the sidewall 412. The magnet 42 is a permanent magnet. In this embodiment, the diaphragm (shown in FIGS. 2-4) could be connected to the outer pole plate 432. And, for enlarging the vibration space of the diaphragm, the outer pole plate 432 is optionally higher than the inner pole plate 431. In an alternative embodiment, the outer pole plate is an optional element, and without the outer pole plate, the diaphragm could be positioned on the sidewall 412 directly.

Figure 7:
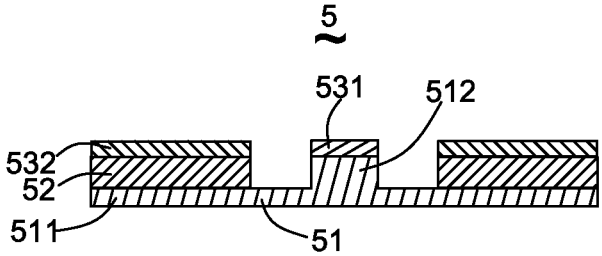
FIG. 7 is a cross-sectional view of a magnetic circuit unit of a speaker in accordance with a fourth embodiment of the present invention.

Referring to FIG. 7, the magnetic circuit unit 5 of a fourth embodiment, includes a T-shaped yoke 51 including a bottom wall 511 and a side wall 512 extending upwards from an central portion of the bottom wall 511, a permanent magnet 52 attached to the bottom wall 511, an inner pole plate 531 attached to the side wall 512, and an outer pole plate 532 attached to a top face of the magnet 52. The magnet 52 may be a ring surrounding the side wall 512, or may be a plurality of separated pieces around the side wall 512, for providing a magnetic gap together with the side wall 512.

According to the embodiments described above, the position portion of diaphragm could be directly or indirectly connected to the outer pole plate with a top face of the outer pole plate higher than the inner pole plate. The position portion of diaphragm also could be indirectly connected to the outer pole plate via a gasket with a top face of the gasket higher than that of the inner pole plate. A greater space for vibration of the diaphragm is optional and preferable. A projection of the diaphragm along the vibration direction on the bottom wall is not larger than the bottom wall, by which the speaker is provided with smaller size, or is provided with enlarged magnetic circuit unit. Sound quality of the speaker having such a configuration is accordingly improved. The elastic plate having a distal end protruding outwardly from the outer side of the speaker is capable of electrically connecting to the external circuit.

Figure 8:
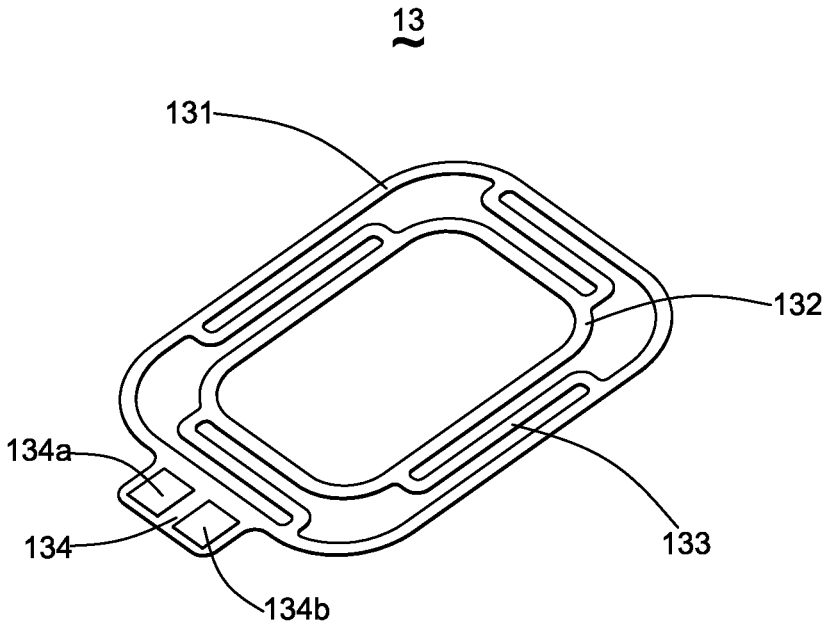
FIG. 8 is an isometric view of an elastic plate of the speaker of the present invention.

Referring to FIGS. 3*b* and 8, the elastic plate 13 includes an outer ring 131, an inner ring 132, and a plurality of connecting beams connecting the outer ring 131 to the inner ring 132. The distal end of the elastic plate 13 is a protrusion and is defined as a terminal 134 which extends from the outer ring 131. Electrodes 134*a*, 134*b* are provided on the terminal 134. Lead wires of the voice coil are electrically connected to the electrodes 134*a*, 134*b*. As described above, the voice coil may attach to the inner ring 132, or may be attach to the diaphragm passing through the opening formed by the inner ring 132. Alternatively, the elastic plate 13 could be a planar plate having no inner ring or connecting beam. In such situation, the voice coil attaches to the elastic plate. The terminal 134 protrudes from the outer side of the speaker for being capable of connecting to the external circuit.

The embodiments described above may be summarized as follows. A speaker includes a magnetic circuit unit, a diaphragm connected to the magnetic circuit unit, a voice coil for driving the diaphragm to vibrate along a vibration direction, and an elastic plate electrically connecting to the voice coil. The magnetic circuit unit includes an inner part, an outer part, and a magnetic gap formed between the inner part and the outer part. The voice coil is partially received and capable of vibrating in the magnetic gap. One of the inner part and the outer part of the magnetic circuit unit is a magnet. A combination of the elastic plate and an edge of the diaphragm is connected to the outer part of the magnetic circuit unit. By virtue of such a configuration, a projection of the diaphragm along the vibration direction on the magnetic circuit unit is located within the boundary of the magnetic circuit unit, thereby omitting a frame used in the related art for supporting the diaphragm and the magnetic circuit unit. As the frame used in the related art is omitted by this invention, an outer side of the speaker is formed by the outer part of the magnetic circuit unit and the edge of the diaphragm. For enlarging a vibration space of the diaphragm, the outer part is higher than the inner part, or the diaphragm connects to the outer part via a gasket attaching to the top of the outer part.

It will be understood that the above-mentioned particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A speaker, comprising:

a vibrating unit, including a diaphragm, a voice coil driving the diaphragm to vibrate along a vibration direction, and an elastic plate coupled with the diaphragm for electrically connecting to the voice coil, the diaphragm including a position portion serving as an edge of the diaphragm;

a magnetic circuit unit supporting a combination of the diaphragm and the elastic plate, including a base board, a first magnetic conduction member disposed at a central portion of the base board, a second magnetic conduction member around the first magnetic conduction member, and a magnetic gap formed by the first and second magnetic conduction members;

a projection of the diaphragm along the vibration direction on the base board being within an outline of the base board; wherein the magnetic circuit unit further includes a first pole plate attached on the first magnetic conduction member, and a second pole plate attached on the second magnetic conduction member, a top surface of the second pole plate being higher than that of the first pole plate; wherein the speaker further includes an outer side formed by the second magnetic conduction member of the magnetic circuit unit and the edge of the diaphragm, the elastic plate includes a terminal protruding outwardly from the outer side of the speaker, the terminal being provided with a plurality of electrodes electrically connecting to the voice coil.

2. The speaker as claimed in claim 1 including a plurality of separated second magnetic conduction members, each two adjacent second magnetic conduction members forming a gap.

3. The speaker as claimed in claim 1, wherein the second magnetic conduction member is ring-shaped.

4. The speaker as claimed in claim 1, wherein the elastic plate is located between the diaphragm and the voice coil.

5. The speaker as claimed in claim 1, wherein the elastic plate has a terminal protruding outwardly from an outer side formed by the magnetic circuit unit and the diaphragm, the terminal being provided with a plurality of electrodes for electrically connecting the voice coil.

6. The speaker as claimed in claim 5, wherein the elastic plate further includes an outer ring from which the terminal extends, an inner ring for carrying the voice coil, and a plurality of connecting beams connecting the outer ring to the inner ring.

7. The speaker as claimed in claim 1 further including a gasket disposed between the combination and the second pole plate.

8. The speaker as claimed in claim 7, wherein a top face of the gasket is higher than that of the first pole plate.

9. A speaker, comprising:

a magnetic circuit unit including an inner part, an outer part, and a magnetic gap formed between the inner part and the outer part, one of the inner part and the outer part including a magnet;

a diaphragm mounted on and positioned by the outer part of the magnetic circuit unit;

an elastic plate coupling with the diaphragm and supported by the outer part of the magnetic circuit unit;

a voice coil electrically connecting to the elastic plate for driving a combination of the diaphragm and the elastic plate to vibrate along a vibration direction; wherein the speaker further includes an outer side formed by the outer part of the magnetic circuit unit and the edge of the diaphragm, the elastic plate includes a terminal protruding outwardly from the outer side of the speaker, the terminal being provided with a plurality of electrodes electrically connecting to the voice coil.

10. The speaker as described in claim 9 further including a front cover pressing on the edge of the diaphragm or the elastic plate to the outer part of the magnetic circuit unit.

11. The speaker as described in claim 9 further including a gasket between the combination and the outer part of the magnetic circuit unit, the gasket being higher than the inner part of the magnetic circuit unit.

12. The speaker as described in claim 9, wherein the outer part is higher than the inner part.

* * * * *